United States Patent [19]

Carrieri et al.

[11] 4,044,592

[45] Aug. 30, 1977

[54] COINING DIE ASSEMBLY

[75] Inventors: Louis F. Carrieri, La Grange Park, Ill.; James R. Brownell, Delton, Mich.; Robert A. Helrigel; Roderick K. Ward, both of Hastings, Mich.; Jerome J. Wroblewski, Clarendon Hills, Ill.

[73] Assignee: Gulf & Western Manufacturing Company, Southfield, Mich.

[21] Appl. No.: 688,019

[22] Filed: May 19, 1976

[51] Int. Cl.[2] ..... B21J 13/02

[52] U.S. Cl. ..... 72/462; 72/359; 72/427; 72/448; 72/450

[58] Field of Search ..... 72/353, 354, 359, 361, 72/470, 462, 421, 405, 447, 448, 450, 427

[56] References Cited

U.S. PATENT DOCUMENTS

| | | | |
|---|---|---|---|
| 790,462 | 5/1905 | Smith | 72/405 |
| 3,283,551 | 11/1966 | Kraft | 72/421 |
| 3,338,084 | 8/1967 | Stegman | 72/404 |
| 3,448,604 | 6/1969 | Finsterwalder | 72/421 |
| 3,477,270 | 11/1969 | Finsterwalder | 72/359 |
| 3,483,726 | 12/1969 | Burke | 72/427 |
| 3,555,861 | 1/1971 | Staecker | 72/4 |
| 3,583,667 | 8/1972 | Merriman | 72/446 |

*Primary Examiner*—C.W. Lanham
*Assistant Examiner*—Gene P. Crosby
*Attorney, Agent, or Firm*—Meyer, Tilberry & Body

[57] ABSTRACT

A unitary coining die assembly is provided which is mountable on the frame of an underdriven coining press independent of the press slide. The die assembly is positioned on the frame above the slide and is comprised of a mounting plate attached to the frame and a pair of support plates suspended therebeneath. An upper coining die is carried by the mounting plate, and a vertically displaceable lower coining die is carried by the lower support plate. A ring providing a die cavity cooperable with the coining dies is carried by the upper support plate. The support arrangement provides for the lower coining die to be pivotal laterally about an axis spaced from the die axis to facilitate access to the component parts. Further, the portion of the upper support plate is pivotal about the same axis to provide access to the die cavity ring and upper coining die. The press slide engages a die pad associated with the lower coining die and displaces the coining die upwardly into cooperable relationship with the upper coining die to shape a coin blank positioned therebetween.

28 Claims, 6 Drawing Figures

COINING DIE ASSEMBLY

This invention relates to the art of coining presses and, more particularly, to a unitary coining die assembly mountable on a press frame independent of the press slide.

The present invention finds particular utility in conjunction with an underdriven coining press and, accordingly, will be described and discussed herein in conjunction with such a press. It will be appreciated, however, that the coining die assembly can readily be employed in conjunction with presses other than underdriven presses.

In the art of coining metal, it is well known that a coin blank is positioned between opposed coining dies which are relatively reciprocable and cooperable to shape the blank upon movement toward one another. The dies are generally mounted in a press, one on the press bed and the other on the press slide, which most often is an overhead slide. Further, the drive mechanism for the press or a portion of the component parts thereof is generally above the dies. Accordingly, in either instance, lubricant for the press slide and/or drive mechanism will fall on the dies necessitating an interruption in production to eliminate this undesirable condition. Furthermore, mounting the die components on the slide and press bed requires that the die components be installed and properly aligned within the press proper. This not only requires considerable time and is achieved only with difficulty, but results in making the slide alignment critical with respect to the slide guide arrangement. Still further, the fact that the die components must be attached to the press slide and bed makes die removal inconvenient and time consuming. Additionally, and slide deflections during press operation can cause inaccuracies in alignment of the coining die components, and these inaccuracies can result in reducing the quality of the coined product, causing excessive wear and/or damage to the component parts of the die tool assemblies, and reducing production rate by requiring a slower press speed than desired in an effort to minimize these disadvantages.

In accordance with the present invention, the foregoing disadvantages and others with regard to previous die arrangements and the association thereof with a coining press are advantageously overcome. In this respect, the present invention provides a unitary coining die assembly in which all of the component parts are mounted as a unit on the press frame independent of any mechanical connection with the slide structure. Accordingly, the coining die members of the assembly can be installed and aligned prior to mounting of the coining die assembly on the press. This not only facilitates achieving accuracy with respect to alignment of the dies independent of the press structure, but additionally makes slide guiding clearances unimportant since there is no mechanical fastening between the slide and the coining die assembly. In this respect, relative reciprocation between the coining dies is achieved merely by moving the press slide into and out of engagement with a die pad associated with one of the coining dies.

The absence of a mechanical connection between the die assembly and slide also eliminates the necessity for accuracy with respect to a coaxial relationship between the axes of the slide and coining die components. Moreover, any inaccuracies in alignment which may exist or develop between the slide and the slide guides are not imposed on the coining die components. Still further, the unitary structure of the coining die assembly facilitates mounting and dismounting of the assembly on the press frame in a minimum amount of time and with minimum effort. This enables a reduction in down time for purposes of maintenance or repair. Moreover, if a second die assembly is available, the die assembly in the press can be readily removed and replaced by the second die assembly, thus practically eliminating down time. This enables reconditioning the removed die assembly outside the press environment and independent of press operation.

Preferably, the die assembly of the present invention is employed in conjunction with an underdriven press and is mounted on the press frame in overlying relationship with respect to the slide. It will be appreciated that this arrangement eliminates the exposure of the coining die components to lubricant dropping from an overhead slide or drive mechanism. This materially reduces the necessity to stop the press in order to clean the die components. Accordingly, it will be appreciated that down time and the resulting loss of production are thus further minimized.

In accordance with another aspect of the present invention, the die assembly structure preferably enables displacement of certain of the component parts thereof to facilitate access to the components of the assembly including the coining dies for purposes of inspection and the performance of minor maintenance such as the changing of the coining die components. Thus, the coining dies per se can be readily inspected without removing the die assembly from the press, and the die components can be readily replaced if necessary in a minimum amount of time and with minimum effort.

It is accordingly an outstanding object of the present invention to provide a coining die assembly which is mountable on and removable from a press frame as a unit.

It is a further object to provide a coining die assembly of the foregoing character in which the coining die components are aligned and maintained aligned during use independent of structural characteristics of the press slide, such as slide guide clearances and alignment inaccuracies, and independent of operational characteristics of the slide such as deflection under load.

Another object is the provision of a coining die assembly of the foregoing character which minimizes down time of a press and loss of production in connection with mounting and removal operations and/or maintenance procedures involving the die assembly.

Still another object is the provision of a coining die assembly of the foregoing character in which the coining dies are readily accessible for inspection and/or maintenance purposes.

Still a further object is the provision of a coining die assembly of the foregoing character which is simple to construct, install and remove from a press, and is efficient in operation.

The foregoing objects and other will in part be obvious and in part pointed out more fully hereinafter in conjunction with the written description of a preferred embodiment of the invention illustrated in the accompanying drawings in which.

Figure 1:
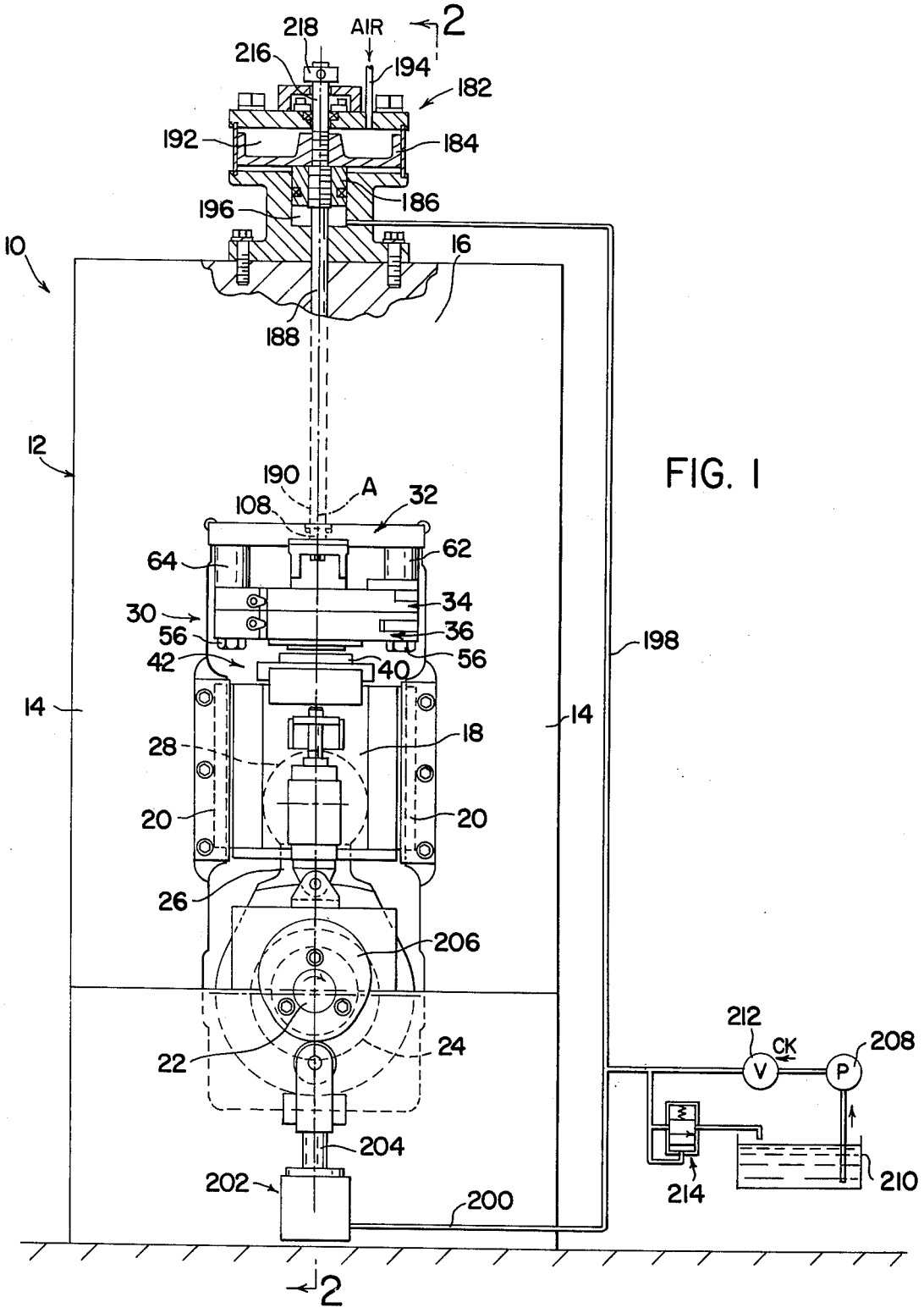
FIG. 1 is a schematic front elevation view of a coining press on which is mounted a coining die assembly in accordance with the present invention.
Figure 2:
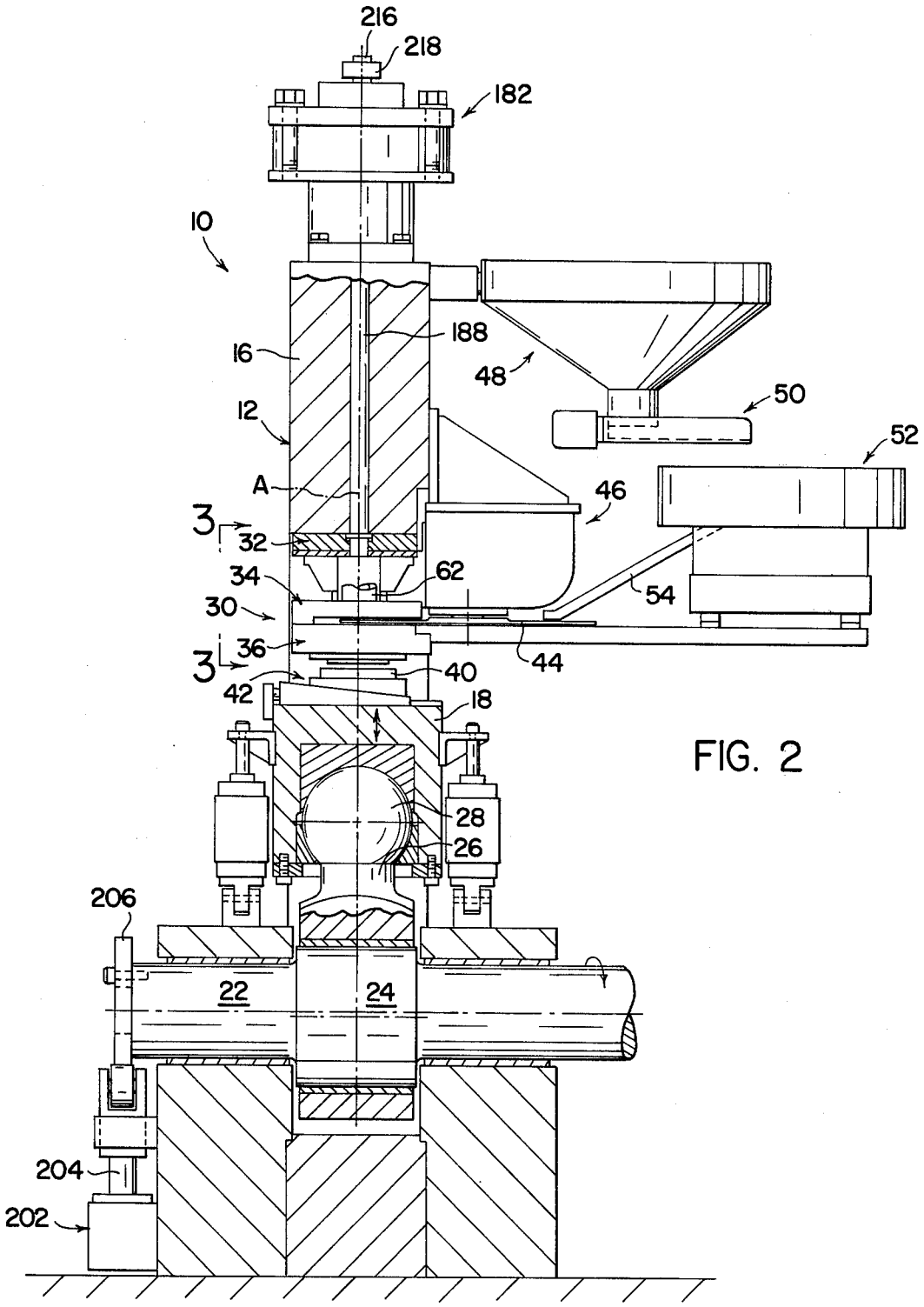
FIG. 2 is an elarged sectional elevation view of the press and die assembly taken along line 2—2 in FIG. 1.

Referring now in greater detail to the drawings wherein the showings are for the purpose of illustrating a preferred embodiment of the invention only and not for the purpose of limiting the invention, an underdriven metal coining press 10 is illustrated in FIGS. 1 and 2 which is comprised of a press frame 12 including side portions 14 and a top portion 16 extending laterally therebetween. A slide 18 is supported for vertical reciprocation relative to the frame through gibbing 20 associated with side portions 14 of the frame. Vertical reciprocation is imparted to slide 18 by means of a drive shaft 22 extending between the front and rear of the frame and having an eccentric 24 thereon. A crank rod 26 has one end operatively associated with eccentric 24 and the other end pivotally interconnected with slide 18 through a knuckle joint 28 whereby, in a well known manner, rotation of the drive shaft imparts vertical reciprocating movement to slide 18.

As shown in FIGS. 1 and 2, a coining die assembly 30, to be described in greater detail hereinafter, is mounted on top portion 16 of the press frame in overlying relationship with respect to slide 18. Assembly 30 has an axis A coinciding with the vertical centerline of press 10. Basically, die assembly 30 includes a mounting plate 32 and upper and lower support plate assemblies 34 and 36, respectively, supported in suspension therebeneath. Mounting plate 32 supports an upper coining die component and lower support plate assembly 36 supports a lower coining die component. As described more fully hereinafter, the lower coining die support is vertically reciprocable relative to plate assembly 36 by means of a die pad extending therebelow which is adapted to be engaged by a slide carried block 40 during upward movement of the slide. The spacing between block 40 and the die pad is preferably adjustable such as by means of a wedge arrangement 42 between the slide and block 40.

As further seen in FIGS. 1 and 2, a rotatable blank transfer or feed wheel 44 is disposed between upper and lower support plate assemblies 34 and 36. Feed wheel 44 is operable through an associated drive mechanism 46 to feed a blank to be coined to a position between the coining dies of assembly 30 in coordination with movement of the press slide through its stroke. The blank transfer mechanism preferably is mounted on top portion 16 of the press frame and is comprised of a circular disc having a plurality of openings 44*a* therethrough to receive a blank, carry the blank to the coining die station and, following the coining die operation, to transfer the shaped blank to a discharge station, not shown. Coin blanks can, for example, be placed in a discharge hopper 48 and fed therefrom by means of a chute 50 to a vibratory type feeder 52 from which the blanks are individually fed along a discharge chute 54 to an input location with respect to feed wheel 44. The feed wheel is not a component part of the coining die assembly and, accordingly, details with regard to the structure and operation thereof are not necessary in connection with understanding the present invention. Moreover, as will become apparent hereinafter, other arrangements for feeding a blank between the die components of die assembly 30 can be employed as well as other arrangements for sequentially supplying coin blanks to the feed wheel illustrated.

Referring now in particular to FIGS. 3–6 of the drawing, mounting plate 32 is rectangular and is adapted to be removably attached to top portion 16 of the press frame by means of four mounting bolts 56. Upper support plate assembly 34 and lower support plate assembly 36 are supported in suspension beneath and parallel to mounting plate 32 by means of a pair of post assemblies 58 and 60 adjacent laterally opposite sides of mounting plate 32. The post assemblies are comprised of corresponding circular spacer members 62 and 64 having their upper ends welded or otherwise secured to mounting plate 32 and having their lower ends abutting the upper surface of upper support plate assembly 34. Spacer member 62 is provided with a circular recess 66 which receives the upper end of a post pin 68. The upper end of pin 68 is suitably retained in recess 66 against axial displacement relative to spacer 62 and, preferably, is releaseably interengaged with spacer 62 such as by a removable retaining pin 70 extending diametrically through spacer 62 and pin 68. Pin 68 extends downwardly through openings therefor in plate assemblies 34 and 36, as will become more apparent hereinafter, and the lower end of pin 68 is threaded to receive a retaining nut 72 which underlies lower plate assembly 36. Spacer 64 is provided with a circular recess 74 which receives the upper end of a circular post pin 76. In a manner similar to that described above with regard to post pin 68, pin 76 is preferably removably interengaged with spacer 64 by means of a retaining pin 78 extending diametrically through spacer 64 and pin 76. Pin 76 extends downwardly through openings therefor in plate assemblies 34 and 36, and the lower end of pin 76 is threaded to receive a retaining nut 80. As will become more apparent hereinafter, the support post arrangement not only facilitates assembly and disassembly of the component parts of the die assembly but further advantageously provides for portions of the support plate assemblies 34 and 36 to be pivotal about the axis of post pin 68.

Figure 6:
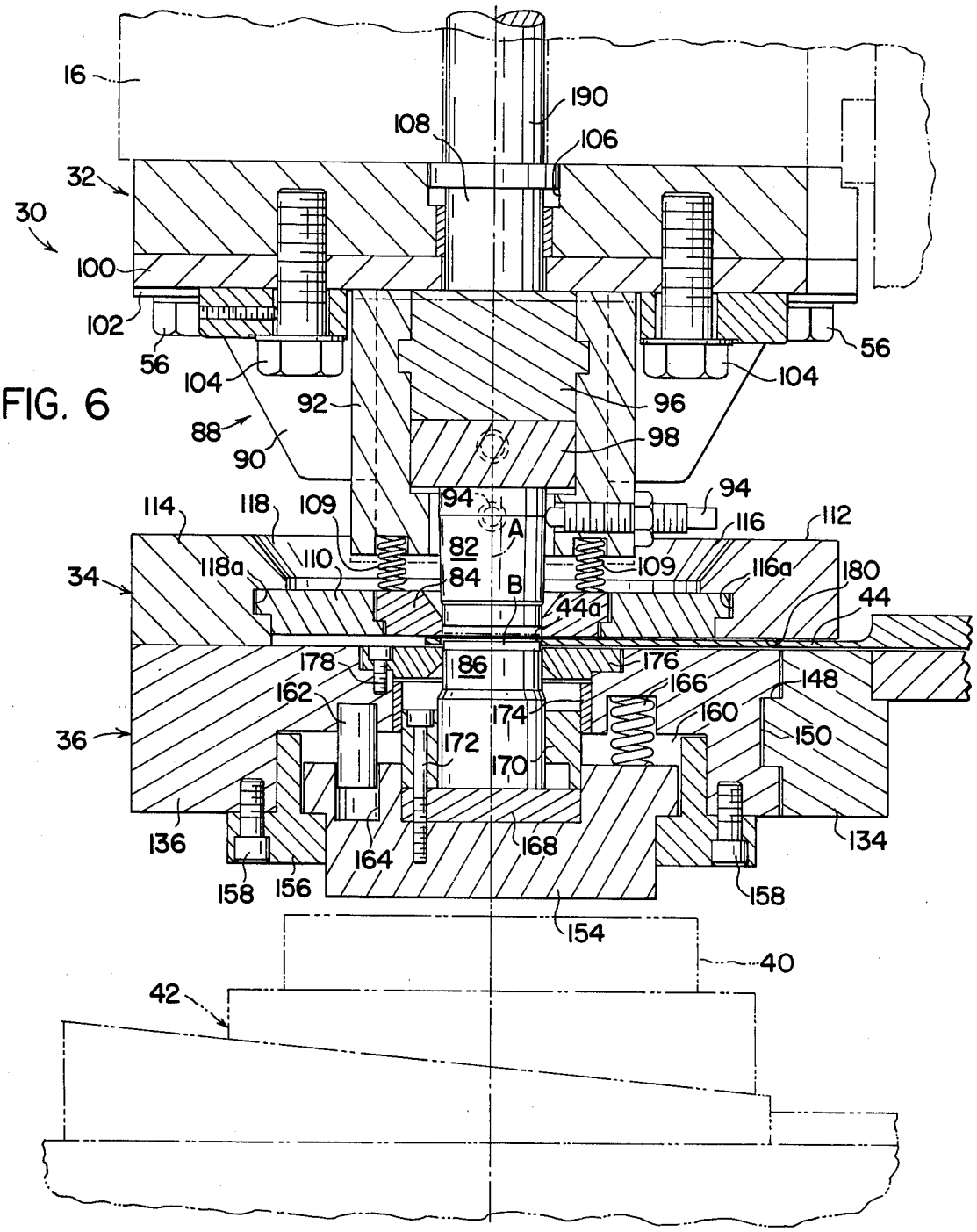

As best seen in FIG. 6, coining die assembly 30 includes an upper coining die member 82, a die cavity forming ring 84, and a lower coining die member 86. Upper coining die member 82 is attached to mounting plate 32 through a removable bracket assembly 88 including a bracket member 90 and a die member support block 92 which is vertically reciprocable relative to bracket 90 for the purpose set forth hereinafter. Support block 92 is provided adjacent its lower end with a plurality of adjustable die setting and aligning screws 94 extending diametrically with respect to die member 82. Screws 94 provide for retaining die member 82 in support block 92 and aligning the axis of the die member relative to the axes of cavity ring 84 and lower die member 86. Further, support block 92 includes a pad member 96 and a wedge member 98 cooperable with the pad member and adjustably interengaged with support block 92 to enable adjusting the axial position of upper die member 82 relative to support block 92. Bracket member 90 underlies a machined back-up plate 100 which is received in a guideway 102 in mounting plate 32. The bracket and back-up plate are removably interconnected with mounting plate 32 by means of a pair of bolts 104 which enable disassembly of the bracket assembly 88 as a unit from the mounting plate.

For the purpose set forth hereinafter, mounting plate 32 is provided with an opening 106 therethrough in axial alignment with coining die member 82, and opening 106 receives and supports an ejector pin 108 for reciprocating movement axially of the opening. Pin 108 is adapted to be displaced downwardly relative to mounting plate 32 and to displace die support block 92 and thus upper die member 82 downwardly relative to the mounting plate. A plurality of coil springs 109 are interposed between the bottom of support block 92 and the upper surface of die cavity ring 84 to bias support block 92 upwardly into engagement with back-up plate 100.

Figure 3:
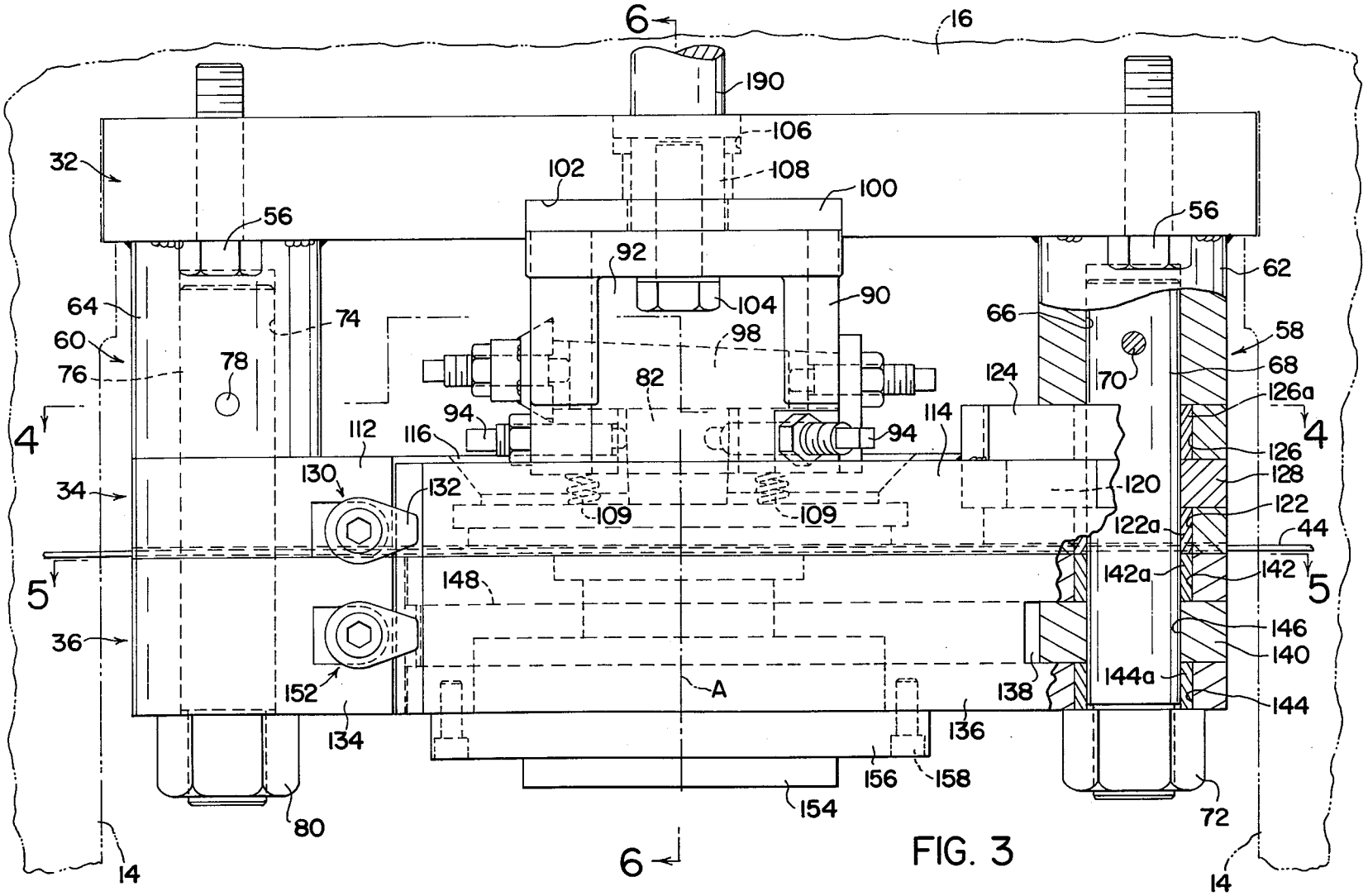
FIG. 3 is an enlarged front elevation view of the coining die assembly.
Figure 4:
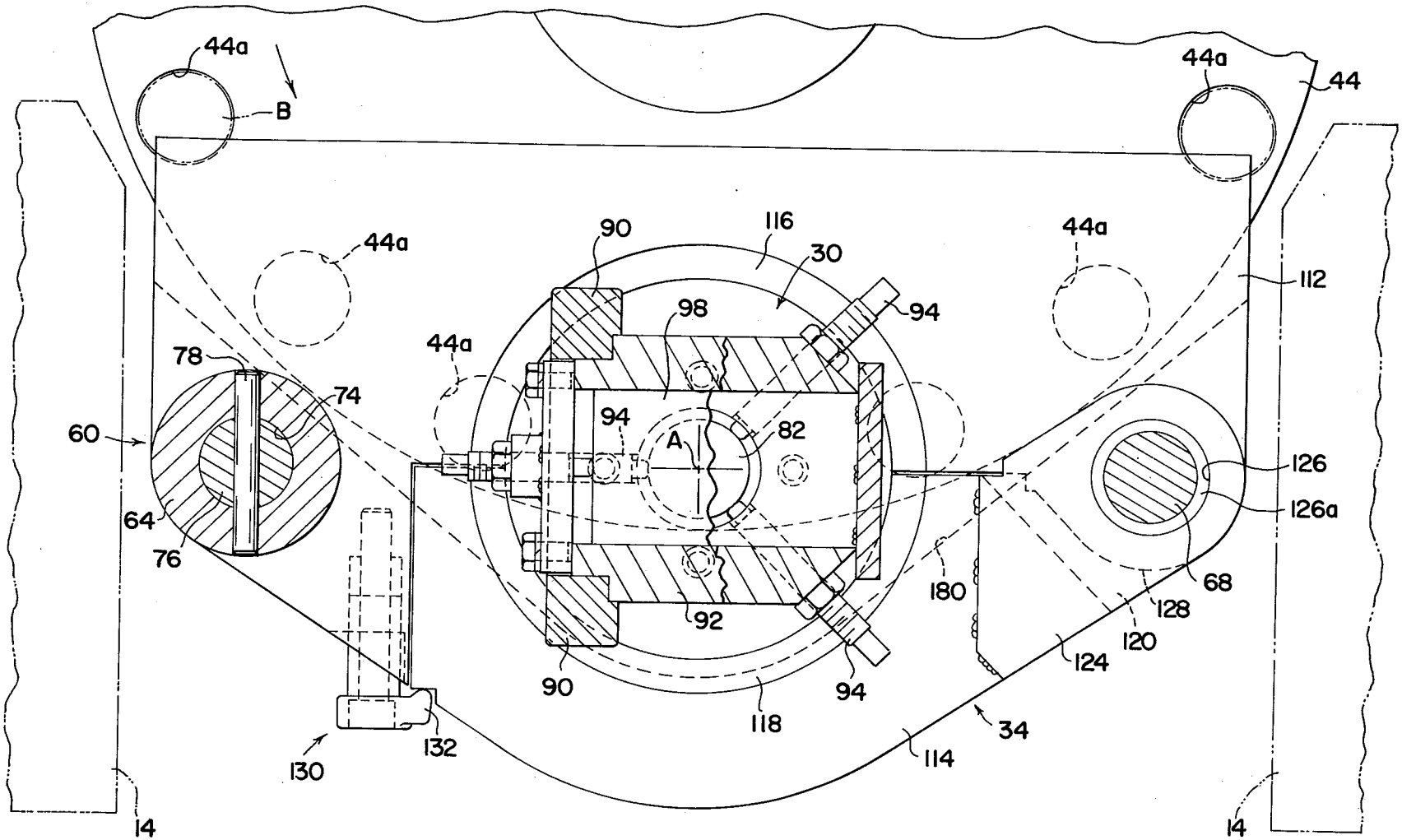
FIG. 4 is a plan view of the upper mounting plate of the die assembly taken along line 4—4 in FIG. 3.

Again referring to FIG. 6, die cavity forming ring 84 is supported by upper plate assembly 34 in axial alignment with upper die member 82. More particularly, in the embodiment shown, die cavity ring 84 is surrounded by an annular collar 110. The inner periphery of collar 110 and the outer periphery of ring 84 are cooperatively recessed to be separably interengaged such that ring 84 is supported against axial displacement downwardly relative to collar 110. As best seen in FIGS. 3, 4 and 6, plate assembly 34 includes generally coplanar plate members 112 and 114 provided with corresponding semicircular openings 116 and 118 which cooperatively define an annular opening through the plate assembly when plate members 112 and 114 are in the positions shown in FIG. 4. Openings 116 and 118 are provided with corresponding recesses **116*a* and 118*a* which cooperatively provide a peripheral recess to receive the correspondingly contoured outer peripheral edge of collar 110**.

Plate member 114 of support plate assembly 34 is pivotal relative to plate member 112 about an axis laterally spaced from and parallel to axis A of the die assembly. In the embodiment shown, plate portion 114 is hingedly interconnected with post pin 68 for pivotal movement about the axis of the post pin. The hinged connection is achieved by providing a recess in the upper portion of plate member 114, as indicated by numeral 120, and providing an aperture 122 in the remaining portion of plate member 114 to receive pin 168. Further, a hinge plate 124 is provided on the upper surface of plate member 114 is overlying relationship with recess 120. Hinge plate 124 is welded or otherwise secured to plate member 114 and is provided with an opening 126 to receive pin 68. Still further, the lower portion of plate member 112 in the area of post assembly 58 is recessed so as to provide a hinge leaf portion 128 which is disposed in recess 120 in plate member 114. Hinge leaf 128 is provided with an opening to receive pin 68, and it will be seen that this structural interrelationship provides for plate member 114 to pivot laterally about the pin axis. Preferably, openings 122 and 126 are provided with bearing sleeves **112*a* and 126*a***to enhance pivotal movement.

Plate member 114 is releaseably latched in the position shown in FIG. 4 by a suitable latch mechanism 130 mounted on plate member 112 and having a nose 132 overlying plate member 114 when the latch assembly is in the latched position. It will be appreciated that by rotating the latch nose 90° from the position shown in FIGS. 3 and 4 that plate member 114 is released for pivotal movement counter-clockwise from the position shown in FIG. 4. It will be further appreciated that such pivotal movement of plate portion 114 exposes the corresponding portion of collar 110. As described more fully hereinafter, such pivotal movement also facilitates inspection, maintenance and replacement operations with regard to die cavity ring 84 and upper coining die member 82.

Figure 5:
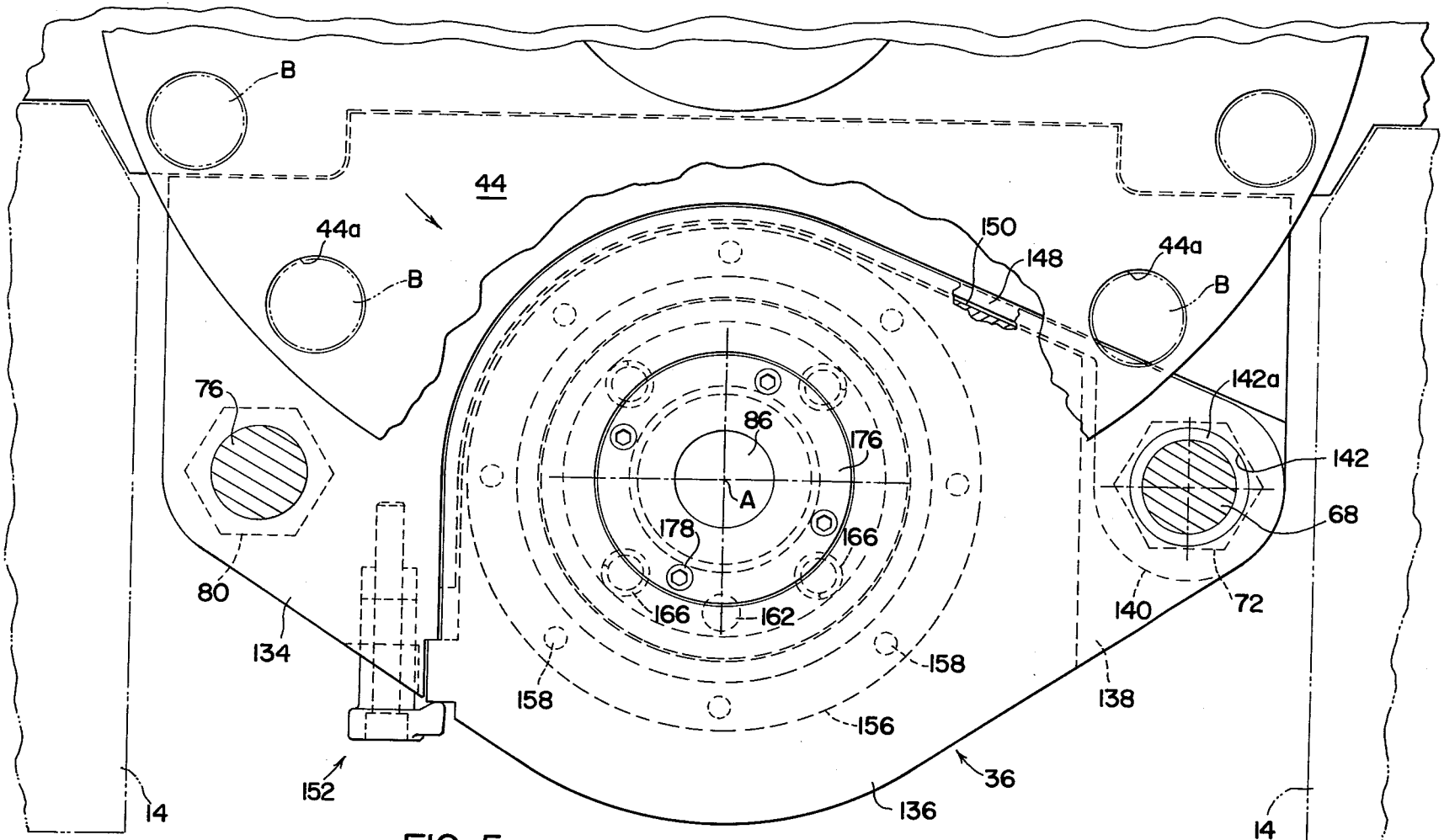
FIG. 5 is a plan view of the lower mounting plate of the die assembly taken along line 5—5 in FIG. 3; and, FIG. 6 is a sectional elevation view of the die assembly taken along line 6—6 in FIG. 3.

Lower coining die member 86 is supported by lower support plate assembly 36 and for axial reciprocation relative thereto. Additionally, support plate assembly 36 provides for the lower die member to be pivotal laterally of die assembly axis A about a pivot axis spaced from and parallel to axis A. More particularly, as best seen in FIGS. 3 and 5, support plate assembly 36 includes generally coplanar plate members 134 and 136 structurally interengaged with one another and with post assembly 58 to enable pivotal movement of plate member 136 about the axis of post pin 68. In this respect, plate member 136 is provided with a recess 138 adjacent post assembly 58, and the upper and lower portions of plate member 134 are recessed to provide a hinge leaf 140 received in recess 138. The upper and lower portions of plate member 136 defining recess 138 are provided with aligned openings 142 and 144 for post pin 68, and hinge leaf 140 is provided with an opening 146 for the post pin. Preferably, openings 142 and 144 are provided with corresponding bearing sleeves **142*a* and 144*a* to enhance the pivotal connection. The juxtaposed edges of plate members 134 and 136 are provided with an interengaging projection and recess contour which, in the embodiment disclosed, is defined by a projection 148 on plate member 134 and a recess 150 on plate member 136. Plate member 134 is releaseably retained in the position shown in FIG. 5 by means of a latch assembly 152 similar to latch assembly 130** described hereinabove.

Plate member 136 of lower support assembly 36 is provided with an opening therethrough in which lower coining die member 86 is supported by means of a die member support arrangement removably mounted on support plate 136. More particularly, the die member support arrangement includes a die pad 154 mounted on plate member 136 by means of a retaining collar 156 which is attached to plate 136 by means of a plurality of fasteners 158. The opening through plate member 136 provides a recess 160 which enables axial reciprocation of die pad 154 relative to plate member 136. A guide pin 162 is suitably attached to plate member 136 and is received in a guide recess 164 in die pad 154 to prevent rotation of the die pad relative to assembly axis A. A plurality of coil springs 166 are interposed between plate member 136 and die pad 154 to bias the die pad downwardly toward engagement with retaining collar 156.

Die pad 154 carries a finished back-up plate 168 and a finished sleeve 170. Plate 168 and sleeve 170 are attached to the die pad by fasteners 172 and together define a seating recess for lower die member 86. Preferably, a bearing sleeve 174 is carried by plate member 136 and surrounds the upper end of sleeve 170 to enhance reciprocating movement of the sleeve relative to plate 136. Further, a collar 176 surrounds the upper end of die member 86 and is suitably fastened such as by studs 178 to plate member 136. It will be appreciated from the foregoing description that displacement of die pad 154 upwardly relative to plate member 136 displaces lower coining die member 86 upwardly toward upper coining die member 82. Moreover, it will be appreciated that rotation of latch assembly 152 90° from the position shown in FIG. 3 releases plate member 136 for pivotal movement about the axis of post pin 68, whereby lower coining die member 86 and the die support arrangement therefor is displacable as a unit counterclockwise from the position shown in FIG. 5 to a position in which the component parts are readily accessible for maintenance, repair or replacement operations.

As seen in FIG. 6, plate member 112 of upper support plate assembly 34 and plate members 134 and 136 of lower support plate assembly 36 are provided with a lateral recess 180 therebetween to receive feed wheel 44 by which a blank B to be coined is positioned between the coining die members. As mentioned hereinbefore, feed wheel 44 is provided with a plurality of blank receiving apertures 44*a* for receiving and transferring a blank to the die station and for transferring a blank from the die station following a coining operation.

Referring back to FIGS. 1 and 2 in conjunction with the structure shown in FIG. 6, the intermittent movement of feed wheel 44 is coordinated with the stroke of press slide 18 so that a blank to be coined is positioned between die members 82 and 86 during that portion of the slide stroke in which slide plate 40 is disengaged from die pad 154. Feed wheel 44 stops when the blank is positioned between the coining dies and remains in this position until the coining operation is completed. Accordingly, as best seen in FIG. 6, upward movement of the press slide causes plate 40 to engage die pad 154 and displace the latter and thus lower coining die 86 upwardly to transfer coin blank B from feed wheel 44 into die cavity ring 84 and into engagement with upper coining die member 82. Upon downward movement of the slide, springs 166 bias lower coining die member 86 downwardly to its initial position, and upper coining die member 82, as described hereinafter, is biased downwardly to displace the coined blank from die cavity ring 84 back into the opening in feed wheel 44. The feed wheel is then advanced one step to displace the coined blank from between the die members and to position another blank therebetween.

Preferably, upper coining die member 82 is in the uppermost position thereof as shown in FIG. 6 during movement of a coin blank upwardly into engagement therewith to achieve shaping of the blank. Further, it is desirable to provide a bias against coining die member 82 in the direction toward coining die member 86 to assure proper ejection of a coined blank from cavity ring 84 to feed wheel 44. In the embodiment herein illustrated, upward positioning of the upper coining die is achieved by coil springs 109 disposed between die support block 92 and cavity ring 84, and the ejection capability is achieved by an ejector arrangement coordinated with movement of the slide through its stroke. More particularly, as best seen in FIG. 1, a cylinder 182 is mounted on top portion 16 of the press frame and houses reciprocable air and hydraulic fluid actuated pistons 184 and 186, respectively. Both pistons are rigidly attached to a piston rod 188 having a lower end 109 which abuts against ejector pin 108 of the coining die assembly. Cylinder 182 and piston 184 provide an air chamber 192 adapted to receive air under constant pressure through line 194 connected to a suitable air source, not shown. Cylinder 182 and piston 186 define a hydraulic fluid receiving chamber 196 connected to a source of hydraulic fluid under pressure through line 198. Line 198 is connected to an outlet line 200 of a hydraulic cylinder 202 disposed beneath drive shaft 22 of the press. A reciprocable piston 204 is provided in cylinder 202 and is reciprocable relative to cylinder 202 by means of an actuating cam 206 on press shaft 22. A hydraulic pump 208 supplied hydraulic fluid from a source 210 to lines 198 and 200 through a check valve 212 and a pressure responsive relief valve 214.

When the press slide is in its lowermost position as shown in FIG. 1, cam 206 provides for piston 204 to be in an uppermost position relative to cylinder 202 to minimize the hydraulic fluid pressure in chamber 196 of cylinder 182. The hydraulic fluid pressure at this time is such that the air under constant pressure behind piston 184 displaces piston rod 188 downwardly to displace ejector pin 108 and thus upper coining die member 82 downwardly from the solid line to the broken line position shown in FIG. 6, thus to eject a coined blank from die cavity ring 84. As the press slide begins to move upwardly cam 206 displaces piston 204 downwardly, thus to increase the hydraulic fluid pressure in chamber 196. This pressure acting against piston 186 overcomes the air pressure in chamber 192, whereby piston rod 188 is displaced upwardly allowing springs 109 to displace die support block 92 to the uppermost position thereof shown in FIG. 6.

When the press slide reached its uppermost position to complete the coining operation and beings its descent, the contour of cam 206 permits upward movement of piston 204. This movement relieves the hydraulic fluid under pressure in chamber 196, whereby the air pressure behind piston 184 causes piston rod 188 to move downwardly such that upper coining die member 82 follows the descent of the lower coining die member to achieve the blank ejection from cavity ring 84. Pressure actuated relief valve 214 in the hydraulic fluid system enables fluid leakage back to source 210 in response to an increase in pressure in lines 198 and 200 resulting from downward movement of piston 184 during the ejection operation. Any such leakage from the system which would cause the pressure to drop below the desired level on the downstream side of check valve 212 is replenished by pump 208. Preferably, pistion 188 has an upper end 216 threaded to receive a nut or collar 218 which engages cylinder 182 to limit downward movement of the piston rod. The threaded interengagement between rod end 216 and collar 218 advantageously provides for adjusting the extent of downward movement of piston rod 188 and thus the ejection stroke in the downward direction.

Referring again to FIGS. 3–6, it will be seen that coining die assembly 30 is readily mounted and dismounted from the press frame by means of the four bolts 56. It will be appreciated therefore that if a second die assembly is available for replacement purposes, failure of a first die assembly in a press, or the need for performing major maintenance thereon, results in substantially zero down time for the press. Even if a second die assembly is not available, the structural interrelationship between the component parts of the die assembly enable inspection, maintenance and/or replacement of component parts of the die assembly to be achieved with less down time than heretofore required. In this respect, pivotal movement of lower support plate member 136 counterclockwise from the position shown in FIG. 5 facilitates the inspection of both the upper and lower coining die members, and permits access to the lower coining die member and the component parts of its support arrangement to facilitate maintenance and/or replacement operation with regard thereto. Further, pivotal movement of upper support plate member 114 counterclockwise from the position thereof shown in FIG. 4 exposes the corresponding portion of collar 110, increases accessibility to the upper coining die support block, and enables removal of the support block, upper coining die member 82, cavity ring 84 and collar 110 simply by removing the two bolts 104 and sliding bracket assembly 88 laterally of mounting plate 32.

Additionally, when the coining die assembly is removed from the press as a unit, it will be appreciated that the component parts are readily accessible and easy to work with. Accordingly, proper alignment between the upper and lower coining die members can be achieved more quickly and with more accuracy than possible in connection with previous arrangements in which the die components are fastened one to the press frame and the other to the press slide, whereby alignment must take place within the confines of the press and subject to inaccuracies in slide alignment and the like.

While considerable emphasis has been placed herein on a preferred structural embodiment of the present invention, it will be appreciated that many embodiments of the invention can be made and that many changes can be made in the embodiment herein disclosed without departing from the principles of the present invention. Accordingly, it is to be distinctly understood that the foregoing descriptive matter is to be interpreted merely as illustrative of the present invention and not as a limitation.

What is claimed is:

1. A unitary coining die assembly for mounting on a press having a frame and slide means reciprocable in opposite directions relative to said frame, said die assembly including first coining die means, second coining die means, support means for said first and second coining die means and supporting said second coining die means for reciprocation between first and second positions relative to said first coining die means, said second coining die means in said first position being spaced from said first coining die means for a coin blank to be received therebetween, said second coining die means in said second position being cooperable with said first coining die means to shape said blank, means biasing said second coining die means toward said first position, and said support means including means to mount said die assembly on said frame for reciprocation of said slide means in one of said opposite directions to engage and displace said second die means from said first position toward said second position.

2. The coining die assembly according to claim 1, wherein said first coining die means includes a first coining die member and ring means defining a die cavity therewith to receive said coin blank when said second die means is in said second position, said support means incuding means supporting and first coining die member for displacement axially of said ring means to eject a shaped blank from said cavity.

3. The coining die assembly according to claim 1, wherein each said first and second coining die means has a die axis and said support means includes means supporting at least one of said first and second coining die means for pivotal movement about an axis spaced from and parallel to the corresponding die axis.

4. The coining die assembly according to claim 3, wherein said one of said coining die means is said second die means.

5. The coining die assembly according to claim 1, wherein said means to mount said die assembly includes mounting plate means, and said means supporting said first and second coining die means includes support plate means parallel to said mounting plate means and interconnected therewith in spaced apart relationhip, said first die means including a first coining die member mounted on said mounting plate means, and said second coining die means including a second coining die member mounted on said support plate means for reciprocation relative thereto between said first and second positions.

6. The coining die assembly according to claim 5, wherein said first coining die member is mounted on said mounting plate means for reciprocation relative thereto.

7. The coining die assembly according to claim 5, wherein said support plate means includes first and second portions, said second coining die member having an axis and being mounted on said first portion, and means supporting said first portion for pivotal movement relative to said second portion about an axis parallel to and spaced from said second die member axis.

8. The coining die assembly according to claim 5, wherein said means supporting said first and second coining die means includes second support plate means between said mounting plate means and said support plate means, said second support plate means being spaced from and interconnected with said mounting plate means, said first coining means further including means on said second support plate means defining a die cavity with said first coining die member to receive said coin blank when said second die member moves toward said second position.

9. The coining die assembly according to claim 8, wherein said first coining die member is mounted on said mounting plate means for reciprocation relative thereto and to said means defining a die cavity therewith.

10. The coining die assembly according to claim 9, wherein said support plate means includes first and second portions, said second coining die member having an axis and being mounted on said first portion, and means supporting said first portion for pivotal movement relative to said second portion about an axis parallel to and spaced from said second die member axis.

11. A coining die assembly for mounting on a press having a frame and slide means reciprocable in opposite directions relative to said frame, said die assembly having an axis in said direction and including mounting plate means transverse to said axis and attachable to said frame, support plate means spaced from and parallel to said mounting plate means, means connecting said support plate means to said mounting plate means, first coining die support means on said mounting plate means, second coining die support means mounted on said support plate means for axial reciprocation relative thereto, said first and second coining die support means having axes coaxial with said assembly axis, collar means on said support plate means and having a die cavity opening therethrough coaxial with said assembly axis, said collar means being located between said first and second coining die support means, said second coining die support means including pad means facing said slide means when said coining die assembly is mounted on said press frame, said pad means being engaged by said slide means to displace said second coining die support means axially toward said first coining die support means.

12. The coining die assembly according to claim 11, wherein said support plate means includes means supporting said second coining die support means for displacement from the position thereof coaxial with said assembly axis.

13. The coining die assembly according to claim 11, wherein said support plate means includes a plate portion displacable to laterally expose said collar means.

14. The coining die assembly according to claim 11, and means biasing said second coining die support means axially away from said first coining die support means.

15. The coining die assembly according to claim 14, wherein said biasing means is spring means between said support plate means and said second coining die support means.

16. The coining die assembly according to claim 11. and means supporting said first coining die support means on said mounting plate means for axial reciprocation toward and away from said support plate means.

17. The coining die assembly according to claim 16, and means biasing said first coining die support means away from said support plate means.

18. The coining die assembly according to claim 17, wherein said biasing means is spring means between said first coining die support means and said support plate means.

19. The coining die assembly according to claim 18, and spring means between said support plate means and said second coining die support means biasing said second coining die support means axially away from said first coining die support means.

20. The coining die assembly according to claim 11, wherein said support plate means includes movable plate means, said second coining die support means being mounted on said movable plate means, and means supporting said movable plate means for displacement between first and second positions relative to said assembly axis and in which the axis of said second coining die support means is respectively coaxial with said assembly axis and laterally spaced therefrom.

21. The coining die assembly according to claim 20, and means releaseably retaining said movable plate means in said first position thereof.

22. The coining die assembly according to claim 20, wherein said movable plate means is pivotal in the plane thereof, and means supporting said movable plate means for pivotal movement about an axis parallel to and spaced from said assembly axis.

23. The coining die assembly according to claim 22, and latch means releaseably retaining said plate means in said first position thereof.

24. The coining die assembly according to claim 22, wherein said support plate means further includes second movable plate means pivotal about an axis parallel to said assembly axis and between first and second positions, said second movable plate means in said first position being laterally adjacent said collar means and in said second position laterally exposing said collar means, and means releaseably retaining said second movable plate means in said first position thereof.

25. A coining die assembly for mounting on a press having a frame and slide means reciprocable in opposite directions relative to said frame, said die assembly having an axis in said direction and including mounting plate means transverse to said axis and attachable to said frame, first and second support plate members parallel to and axially spaced from said mounting plate means, said first plate member being between said mounting plate means and said second plate member, post means laterally spaced from said axis and interconnecting said first and second plate members with one another and with said mounting plate means, first coining die support means mounted on said mounting plate means for reciprocating movement axially thereof, means biasing said first coining die support means toward said mounting plate means, a first hinged member coplanar with said first support plate and interconnected therewith for pivotal movement about a first axis parallel to and laterally spaced from said assembly axis, said first support plate and said hinged member having lateral recesses therein, said hinged member having first and second positions relative to said first support plate, said recesses in said first position being laterally opposed, collar means received in said recesses when said hinged member is in said first position and having a die cavity opening axially therethrough, said hinged member in said second position opposing the lateral portion of said collar means corresponding to the lateral recess in said hinged member, a second hinged member coplanar with said second support plate and interconnected therewith for pivotal movement about a second axis parallel to and laterally spaced from said assembly axis, second coining die support means mounted on said second hinged member for pivotal movement therewith and axial reciprocation relative thereto, said first and second coining die support means and said die cavity opening having axes coaxial with said assembly axis, said second hinged member being pivotal between first and second positions in which the axis of said second coining die support means is respectively coaxial with and laterally spaced from said assembly axis, said second coining die support means including means engageable by said slide means to displace said second coining tool support means axially toward said first coining tool suppport means, means biasing said second coining tool support means axially away from said first coining die support means.

26. The coining die assembly according to claim 25, wherein said means biasing said second coining die support means is spring means between said second hinged member and said second coining die support means.

27. The coining die assembly according to claim 26, wherein said post means includes a sleeve member axially between said mounting plate means and said first plate member, and pin means in said sleeve and extending through openings therefor in said first and second plate members and said first and second hinged members, whereby said hinged members are each pivotal about the axis of said pin means.

28. The coining die assembly according to claim 27, wherein said means biasing said first coining die support means is spring means between said collar means and said first coining die support means.

* * * * *